US005459663A

United States Patent [19]

Franke

[11] Patent Number: 5,459,663

[45] Date of Patent: Oct. 17, 1995

[54] CAB SIGNAL APPARATUS AND METHOD

[75] Inventor: Raymond C. Franke, Glenshaw, Pa.

[73] Assignee: Union Switch & Signal Inc., Pittsburgh, Pa.

[21] Appl. No.: 165,094

[22] Filed: Dec. 10, 1993

[51] Int. Cl.[6] ..... B61L 1/18; B61L 23/20; B61L 29/18

[52] U.S. Cl. ..... 364/426.05; 364/436; 246/4; 246/34 CT; 246/167 R; 246/122 R

[58] Field of Search ..... 364/426.05, 424.01, 364/436, 174; 246/4, 62, 34 B, 34 R, 34 CT, 122 R, 175, 177, 179, 182 R, 128; 324/388, 503

[56] References Cited

U.S. PATENT DOCUMENTS

| | | | |
|---|---|---|---|
| 3,246,141 | 4/1966 | Ehrlich | 246/34 |
| 3,359,416 | 12/1967 | Wilcox | 246/34 |
| 3,526,378 | 9/1970 | Thorne-Booth | 246/122 |
| 3,666,217 | 5/1972 | Sibeey | 246/34 CT |
| 3,696,243 | 10/1972 | Risely | 246/121 |
| 3,781,541 | 12/1973 | Darrow et al. | 246/128 |
| 3,794,833 | 2/1974 | Blazek et al. | 246/63 C |
| 3,821,544 | 6/1974 | Matty | 246/34 CT |
| 3,868,075 | 2/1975 | Blazek et al. | 246/34 CT |
| 4,026,506 | 5/1977 | Bourke et al. | 246/34 R |
| 4,307,860 | 12/1981 | Kuhn | 246/128 |
| 4,314,234 | 2/1982 | Darrow et al. | 340/825.36 |
| 4,320,881 | 3/1982 | Campbell | 246/34 B |
| 4,415,134 | 11/1983 | Wilson | 246/34 CT |
| 4,437,056 | 3/1984 | Pierro, Jr. | 324/388 |
| 4,467,270 | 8/1984 | McElroy et al. | 324/503 |
| 4,494,717 | 1/1985 | Corrie et al. | 246/28 F |
| 4,498,650 | 2/1985 | Smith et al. | 246/122 R |
| 4,550,889 | 11/1985 | Emmel | 246/28 R |
| 4,619,425 | 10/1986 | Nagel | 246/34 R |
| 4,723,739 | 2/1988 | Franke | 246/34 C |
| 4,728,063 | 3/1988 | Petit et al. | 246/34 R |
| 4,886,226 | 12/1989 | Frielinghaus | 246/121 |
| 5,145,131 | 9/1992 | Franke | 246/122 R |
| 5,263,669 | 11/1993 | Ehrlich | 246/34 B |
| 5,263,670 | 11/1993 | Colbaugh et al. | 246/63 R |

*Primary Examiner*—Kevin J. Teska
*Assistant Examiner*—Tan Nguyen
*Attorney, Agent, or Firm*—Buchanan Ingersoll

[57] ABSTRACT

An apparatus and method for supplying cab signal to a rail vehicle on a section of track composed of sequentially adjacent railway track circuit blocks. Respective receivers of each track circuit block are monitored for the presence of a vehicle within that block. The cab signal apparatus is controlled to transmit a signal to a block when the output from the respective receiver in that block indicates a different condition from the adjacent receiver of an adjacent block. Output voltages from adjacent receivers are compared to enable transmission of a cab signal. Comparison of adjacent receiver outputs is accomplished through use of a diode bridge.

13 Claims, 2 Drawing Sheets

CAB SIGNAL APPARATUS AND METHOD

BACKGROUND OF THE INVENTION

Present practice in railway signaling makes use of track circuits for train detection and for cab signal. Train detection is most often used for wayside signaling to detect the presence or absence of a train or broken rail and display such a signal to an entering train. Cab signaling circuits provide information concerning track operating conditions to the operator on-board the vehicle. In some installations one signal may provide both of these functions. It is also common to use audio-frequency track circuits for train detection and a different audio-frequency for the cab signal. The cab signal audio-frequency is often coded at a rate indicative of the speed command. The cab signal is fed into the rails and received inductively by an antenna or an induction pick-up mounted usually ahead of the lead axle of the train or elsewhere on the vehicle. It is common practice to use a higher code rate for progressively greater speed commands and to remove the cab signal carrier for a stop command. Because the train should at all times respond to the cab signals that it receives, it is common to inject the cab signal into the rails in advance of the train shifting from one track circuit to another. In such a manner there is no time delay in which a cab signal would be unavailable to a moving train as it passes from one block to another. The loss of a cab signal to a moving train even for a momentary period can result in an unnecessary delay in the orderly flow of traffic on the rails. Normally a track circuit consists of a transmitter at one end and a corresponding receiver at the other end of a block. As long as a proper signal is detected by the receiver, the receiver maintains a relay or equivalent device energized. When the signal is shunted by the presence of a train in the block, the receiver causes the relay to de-energize thereby indicating an occupied track circuit. Various track relays are used to form a selection network which picks the code rate which represents the speed at which the train must not exceed. Such relays are usually vital relays of high precision and corresponding cost. To avoid a second train from following a first vehicle into a block it has been the practice to use vital track relays to cut off the cab signals in the track circuit immediately behind the train. The relay circuitry therefore has provided a means in which cab signals are applied to the block in which the train is located, while removing the cab signal from the block behind the moving vehicle. There would be a significant economic advantage to using a microprocessor controlled logic to perform the speed command selection function and also eliminate the vital relays which are presently used in the cab signal circuitry. Present vital microprocess systems are too slow as a means of quickly applying the cab signal at the entrance to the track circuit. This slow response could cause a momentary loss of cab signal at track circuit boundaries and result in an undesirable train operation. The train operator could be given a stop signal.

SUMMARY OF INVENTION

The invention provides for a cab signal apparatus which supplies cab signals to a rail vehicle on a track section having sequentially arranged adjacent track circuit blocks. The cab signal transmission to each block is controlled by comparing the output of the respective track circuit receiver with the output of the track circuit receiver of an adjacent block. If a difference between the two outputs exists an enabling signal initiates a cab signal transmission to the block. The comparison between adjacent track circuit receiver outputs can be accomplished using a diode bridge. Each respective block's cab signal unit receives the output from an adjacent track circuit receiver and likewise outputs its own track circuit receiver output to the cab signal unit of another adjacent block. The enabling signal can be used to initiate or supply a cab signal oscillator. The oscillator output may be modulated by specific track codes which have been generated for the respective block. In digital systems the enabling signal may be compared to a carrier signal and a code signal to generate a cab signal which is then fed to the track block. In this way the cab signal will always be applied to the block in which the vehicle is located.

DESCRIPTION OF PREFERRED EMBODIMENTS

Figures 1A, 1B:
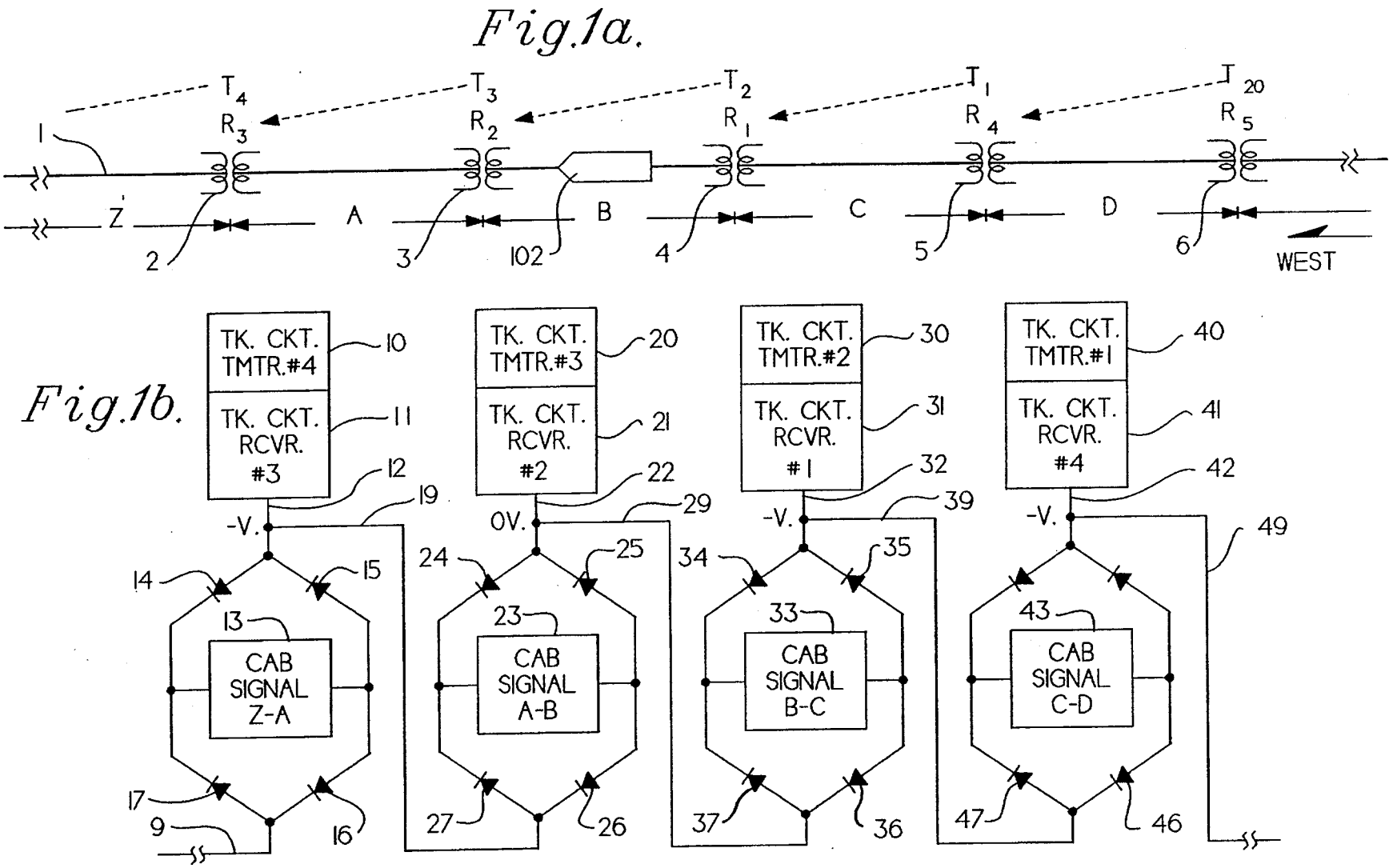
FIG. 1*a* is a diagrammatic representation of a vehicle track having sequentially arranged track circuit blocks, Z, A, B, C, and D.
FIG. 1*b* is a diagrammatic of a presently preferred embodiment of track circuit transmitters, receivers, and cab signal units as associated with the diagrammatic of FIG. 1A.

Rail vehicle systems commonly use the rails as conductors in electrical circuits to provide signal, control, and information related to vehicular operation. As shown in FIG. 1*a*, a set of rails, reference 1, is shown which has a number of sequentially arranged track circuits, A, B, C, and D. While the blocks A through D are shown being of generally equal length in this diagrammatic, it is understood that the individual track circuits may be of various lengths from a few feet to a few miles, depending upon the specific application and terrain involved. A vehicle 102 is shown positioned to ride upon rails 1. Vehicle 102 may be any rail vehicle, such as a freight train, passenger train, mass transit vehicle, or people mover. As is normally the case the vehicle provides a shunt path between the set of rails to control certain track circuits. The track circuits A through D are shown separated by impedance bonds, 2 through 6. For either direction each track circuit will have a specific track circuit transmitter and track circuit receiver which operate together to provide for detection of the vehicle within the respective track block. As an example, track block A utilizes track circuit transmitter T3 and track circuit receiver R3 to detect a shunt within the block A, such as provided by the wheel and axle set of a vehicle 102 when on the rails in the block A. Similarly, track block B uses track circuit transmitter (T2) and receiver (R2) for detection. Track block C uses transmitter and receiver pairs, T1, R1; and block D uses transmitter/receiver pair T20, R4.

Each of the respective track circuits within the blocks shown in FIG. 1*a* act similarly. Block A which as shown is unoccupied has electrical signal from track circuit transmitter (T3) being conducted within the set of rails 1 from the interface of block B, A to the receiver R3, which picks up its signal at the interface of blocks Z and A. Since the block is unoccupied, and assume that the rail is continuous, i.e., not broken, receiver (R3) is activated. If receiver R3 is a relay, its coil is energized and contacts are closed which can then output a signal having a predetermined voltage. The presence of that voltage at the output of R3 is normally used to indicate an unoccupied section for track circuit A. In contrast, as shown in FIG. 1*a*, track circuit block B is occupied by vehicle 102. As a result, the electrical signal being transmitted by track circuit transmitter (T2) is shunted by the vehicle 102 before the electrical signal can reach track circuit receiver (R2). As a result, R2 is not activated. If R2 is a vital relay, its coil is not energized and therefore its output is zero volts. Such a zero output can be used to indicate the presence of an occupied track section in block B. Similarly, since blocks C and D are unoccupied, their respective transmitters T1 and T20 can activate corresponding track circuit receivers R1 and R4 which then output a voltage signal.

The track circuit transmitters and receivers are generally located wayside and can be used to provide track occupancy information to wayside located signals. However, it is desired to also provide information to the vehicle. FIG. 1*a* would also have associated with each of the sections a cab signal transmitter. These could be separate transmitters or use track circuit transmitters such as T1–T20. The cab signal transmitter associated with each of the respective blocks A through D transmits information related to the specific operating conditions such as the speed command within the respective block to the rails 1. The cab signal information is picked-up from the rails at or in front of the vehicle 102. The vehicle can then decode the information encoded in the cab signal and use it during operation of the vehicle 102. As the vehicle proceeds from one track circuit block to the next, it is desirable for the vehicle to receive the new information from the block it has just entered. In addition, cab signal systems are desired to be operated in a vital mode. It is also undesirable to have a loss of cab signal occur when vehicles 102 enters a new block. To avoid interference between multiple cab signal units transmitting simultaneously and to conserve power, it is desirable to turn-off as many cab signal transmitters as possible in front of and behind the moving vehicle. It is also desirable to turn-off the cab signal unit in the block immediately following the vehicle to avoid having a second vehicle enter that block and erroneously receive the cab signal.

Figure 2:
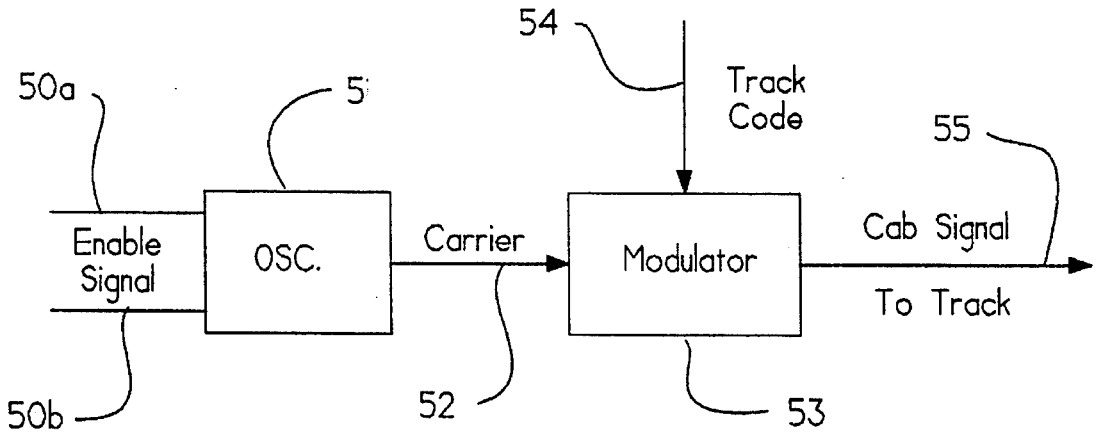
FIG. 2 is a block diagram showing an embodiment using an oscillator and modulator to generate a cab signal.

FIG. 1*b* shows a circuit diagram in which track circuit transmitters T4, T3, T2, T1 are shown respectively at reference numerals 10, 20, 30, 40. Similarly, receivers R1 through R4 in FIG. 1*a* are shown respectively at reference numerals 31, 21, 11, and 41. The cab signal units for the respective junctions of block Z-A, A-B, B-C, and C-D of FIG. 1*a* are shown in FIG. 2 as reference numerals 13, 23, 33, and 43. Cab signal units 13, 23, 33, 43 are shown as separate units each having a separate transmitter, although such transmitters could be combined with other track circuit transmitters. Receivers R1 through R5 may be any track circuit receiving unit and may include vital relay, solid state devices, or microprocessors. For example, in FIGS. 1*a* and 1*b*, we will assume they are vital relays and that when the coil is activated they have an output of a minus voltage, such as –24 volts. When the relay coil is not energized the output is zero volts. It is evident that other voltage levels, positive voltages or other signals can be used as an output from the track circuit receivers. The minus 24 volts will be used for an example with reference to FIG. 1*b*. Other signals are also encompassed within the scope of this invention.

Referring to FIG. 1*a*, only track circuit B is occupied and therefore receivers R1, R3, and R4 are receiving the proper track signal from their corresponding transmitters, T1, T3, and T20. As a result, in FIG. 1*b* the output of receiver R3, reference 11, and receiver R1, reference 31, and receiver R4, reference 41, have negative voltage outputs. Track circuit receiver R3, reference 11, has an output 12 shown to have –V or a negative voltage. Similarly, track circuit receiver R1, reference 31, has an output signal 32 shown having a –V or negative voltage. Track circuit receiver R4, has an output 42 which is also shown to have an negative voltage. However, track circuit B is occupied and therefore the track circuit signal from transmitter T2, reference 30, is shunted by vehicle 102 and is not properly received by receiver R2, reference 21. Therefore the output signal 22 from track circuit receiver R2 is at zero. When vehicle 102 moves further westward past impedance bond 3, it will no longer shunt the signal from transmitter T2 and receiver R2, reference 21, will change its output, 22, to a negative voltage.

Similarly, when vehicle 102 enters block A receiver R3, reference 11, will have an output 12, which will change from its unoccupied condition of –V to a zero output.

Each of the cab signal units 13, 23, 33, and 43 are enabled by a signal which is the difference between the output of its respective track circuit receiver and the output of the adjacent track circuit receiver. Cab signal unit A-B, 23, is enabled by a signal which is the difference between output 22 from block B track circuit receiver R2 and output 19 from track circuit receiver R3. As shown in FIG. 1*b*, output 19 is at –V while 22 is at zero volts. The result is a voltage differential, 24 volts, across the diode bridge composed of diodes 24, 25, 26, and 27. This enabling signal resulting from the differential voltage between the output of its respective receiver and an adjacent receiver enables cab signal unit 23 to transmit at the junction of block A and block B to provide a cab signal on the rails in block B in advance of vehicle 102.

Assuming that block Z is unoccupied, its respective receiver output 9 is at –V voltage and the difference between output 9 and output 12, also at –V, is zero. Therefore cab signal unit 13 is not provided with an enabling signal through its respective diode bridges 14, 15, 16, and 17. Each cab signal unit monitors its own receiver and the output of the receiver that is adjacent to the block.

However, as shown in FIG. 1*b*, cab signal unit 33 is enabled because the voltage difference between output 29 and output 32 does result in a signal which enables cab signal 33 through the respective diode bridge composed of diodes 34 through 37. Cab signal unit 33 therefore is transmitting at the junction of blocks B and C, behind vehicle 102. Its signal current will also be shorted by the rear axle on vehicle 102 and generally will not travel in an east bound direction a significant distance due to the shunting of the signal current by the railway vehicle axle in block B.

However should another vehicle enter the system, heading in a westerly direction and enter block C the following vehicle would then be within one block of lead vehicle 102. Such a condition may generally not be viewed as desirable. In the system of FIG. 1*b* should a following vehicle enter block C, the cab signal unit B-C, 33, is automatically shut down. This results because the following vehicle when entering block C will cause track circuit receiver R1, reference 31, to drop out. The result is that the output 32 from track circuit receiver R1 will no longer be a negative voltage, but will be zero volts. The result is that the differential signal between 32 and 29 would then be zero voltage, as both signals are at a zero level. Cab signal unit 33 would then not have an enabling signal available to it through its respective diodes 34 through 37. Cab signal unit B-C, 33, does not then transmit a cab signal to the rails 1. In operation the following vehicle would then lose its cab signal and appropriate action could be taken, such as stopping the following vehicle.

While FIGS. 1*a* and 1*b* have been shown as set-up for west bound vehicle flow, the same circuit is operative for east bound direction vehicles. Typically transmitter pairs T1, T2, T3, T4, T20 and R1 through 5 would be reversed. In such a scheme T3 would communicate with R1, T2 with R4, T4 with R2, and similarly for all transmitter/receiver pairs.

FIG. 2 shows an embodiment of cab signal unit that could be used as the cab signal unit shown in FIG. 1*b*. In such a circuit the enabling signal is shown as 50*a* and 50*b*. This two wired input could be the voltage differential resulting from the diode bridges shown in FIG. 1*b*. This enabling signal is fed to an oscillator 51, and can trigger the oscillator to output a cab signal carrier 52. Carrier 52 is fed to a modulator 53 in which the carrier 52 is modulated with a track code 54 such as the speed command. The resulting cab signal 55 is then fed to the track rails.

Figure 3:
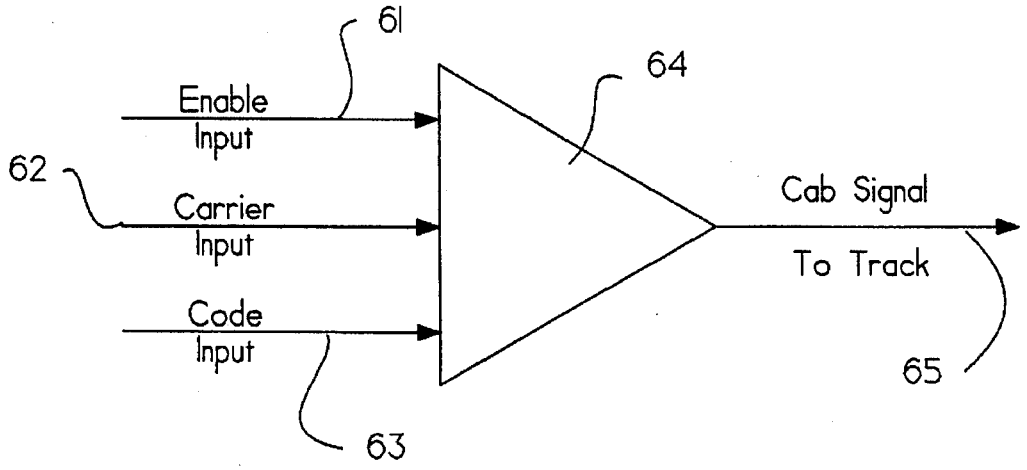
FIG. 3 is a diagrammatic of an embodiment using a digital processor to generate a cab signal.

FIG. 3 shows an embodiment using a digital arrangement in which an enabling signal input 61 such as that obtained from the differential between adjacent track circuits receivers as shown in FIG. 1*b* is fed to a comparator or gate 64. Similarly, a cab signal carrier signal 62 is also fed to gate 64. The information desired to be encoded on the cab carrier signal is delivered by a code signal 63 to the gate 64. When all three signals 61, 62, 63 are present, the gate 64 outputs a signal, 65, to the track rails. In this way information can be encoded into the carrier when the enabling signal is present to provide a cab signal to the respective blocks.

While certain presently preferred embodiments of the invention have been described herein, it is to be understood that other embodiments will be apparent and are included within the scope of the following claims.

I claim:

1. A cab signal apparatus to supply cab signals to a rail vehicle on a track section having an arrangement of sequentially adjacent track circuit blocks, each of said blocks having a track circuit transmitter and a respective track circuit receiver to detect the presence of such vehicle on rails in the respective blocks by receipt of a track signal from such track circuit transmitter, the cab signal apparatus comprising:

means for receiving a block output signal from the respective track circuit receiver of at least one of said blocks;

means for receiving an adjacent signal from an adjacent receiver of an adjacent one of such track circuit blocks adjacent said at least one of said blocks;

comparison means for comparing said block output signal with said adjacent signal and supplying an enabling signal when a difference exists between said block signal and said adjacent signal;

cab signal transmitting means for transmitting a cab signal to said rails in response to said enabling signal; and means for supplying said block output signal to respective cab signal apparatus of another adjacent one of such track circuit blocks.

2. The cab signal apparatus of claim 1 wherein said difference is a voltage difference between said block output signal and said adjacent signal.

3. The cab signal apparatus of claim 2 wherein said comparison means comprises a diode bridge fed by said block output signal from such track circuit receiver of the at least one of said blocks and said adjacent signal from one of such track circuit receivers adjacent said at least one of said blocks.

4. The cab signal apparatus of claim 3 wherein said enabling signal comprises a rectified output signal from said diode bridge.

5. The cab signal apparatus of claim 4 wherein said cab signal transmitting means includes a cab signal oscillator which is triggered by said enabling signal.

6. The cab signal apparatus of claim 4 wherein said cab signal transmitting means includes a comparator means for comparing said enabling signal and a carrier signal and a code signal; and said comparator outputting a cab signal in the response to the presence of said enabling signal and said carrier signal and said code signal.

7. The cab signal apparatus of claim 1 wherein said enabling signal comprises a rectified output signal from a diode bridge.

8. The cab signal apparatus of claim 1 wherein said cab signal transmitting means includes a cab signal oscillator which is triggered by said enabling signal.

9. The cab signal apparatus of claim 1 wherein said cab signal transmitting means includes a comparator means for comparing said enabling signal and a carrier signal and a code signal; and said comparator outputting a cab signal in the response to the presence of said enabling signal and said carrier signal and said code signal.

10. A method for controlling a cab signal apparatus to supply cab signals to a track section having an arrangement of sequentially adjacent track circuit blocks, each of said blocks having a respective track circuit transmitter and a track circuit receiver, the method comprising:

monitoring at least one of said blocks for the presence of a rail vehicle one of said blocks;

monitoring an adjacent block for the presence of a vehicle on said adjacent block; and supplying a cab signal to said one of said blocks when a vehicle is detected on said one of said block or said adjacent block.

11. The method of claim 10 of supplying cab signal to a track wherein said monitoring of said one block includes monitoring the output of the respective receiver of said one of said blocks; and said monitoring of said adjacent block includes monitoring the output of the adjacent receiver of said adjacent block.

12. The method of claim 1 wherein said comparing includes comparing respective voltage outputs of said respective receiver in said one block and said adjacent receiver in said adjacent block.

13. The method of claim 2 wherein said comparing further includes rectifying the voltage difference between said respective receiver in said one block and the voltage output of said adjacent receiver.

* * * * *

UNITED STATES PATENT AND TRADEMARK OFFICE

CERTIFICATE OF CORRECTION

PATENT NO. : 5,459,663

DATED : October 17, 1995

INVENTOR(S) : RAYMOND C. FRANKE

It is certified that error appears in the above-indentified patent and that said Letters Patent is hereby corrected as shown below:

Column 6, line 39, claim 10, after "vehicle" insert --on said--.

Signed and Sealed this

Twenty-seventh Day of February, 1996

*Attest:*

Bruce Lehman

BRUCE LEHMAN

*Attesting Officer*

*Commissioner of Patents and Trademarks*